US005137178A

United States Patent [19]

Stokes et al.

[11] Patent Number: 5,137,178

[45] Date of Patent: Aug. 11, 1992

[54] DUAL TUBE DISPENSER

[75] Inventors: James R. Stokes, Fairfield; Michael H. Lombardi, Stamford, both of Conn.

[73] Assignee: Elizabeth Arden Company. Division of Conopco, Inc., New York, N.Y.

[21] Appl. No.: 686,730

[22] Filed: Apr. 17, 1991

[51] Int. Cl.[5] ..... B65D 35/22; B65D 35/28

[52] U.S. Cl. ..... 222/94; 222/103; 222/145; 222/214

[58] Field of Search ..... 222/94, 103, 214, 143, 222/145

[56] References Cited

U.S. PATENT DOCUMENTS

| | | | |
|---|---|---|---|
| 1,639,699 | 8/1927 | Hopkins et al. . | |
| 1,699,532 | 1/1929 | Hopkins et al. . | |
| 2,092,924 | 9/1937 | Lewis | 222/103 X |
| 2,291,282 | 7/1942 | Hollenbeck | 222/103 X |
| 2,568,286 | 9/1951 | Littlefield | 222/103 |
| 2,819,723 | 1/1958 | Meyer | 222/103 |
| 3,197,071 | 7/1965 | Kuster | 222/145 X |
| 3,362,586 | 1/1968 | Dedoes | 222/214 X |
| 4,211,341 | 11/1980 | Weyn . | |
| 4,487,757 | 12/1984 | Klozpeoplou . | |
| 4,528,180 | 7/1985 | Schaeffer . | |
| 4,687,663 | 8/1987 | Schaeffer . | |
| 4,849,213 | 7/1989 | Schaeffer . | |
| 4,964,539 | 10/1990 | Mueller . | |

FOREIGN PATENT DOCUMENTS

| | | | |
|---|---|---|---|
| 1091936 | 10/1960 | Fed. Rep. of Germany | 222/94 |
| 543681 | 5/1956 | Italy | 222/103 |

*Primary Examiner*—Donald T. Hajec
*Attorney, Agent, or Firm*—Milton L. Honig

[57] ABSTRACT

A dual container is provided for delivering two composition streams held in separate compartment thereof. Each of the compartments is flexible walled and received in a relatively rigid receptacle having a left and right wall positioned on opposite sides of the receptacle. Within each of the latter walls are a respective window through which a button protrudes that when squeezed compresses the respective compartments forcing a composition to exit therefrom.

14 Claims, 3 Drawing Sheets

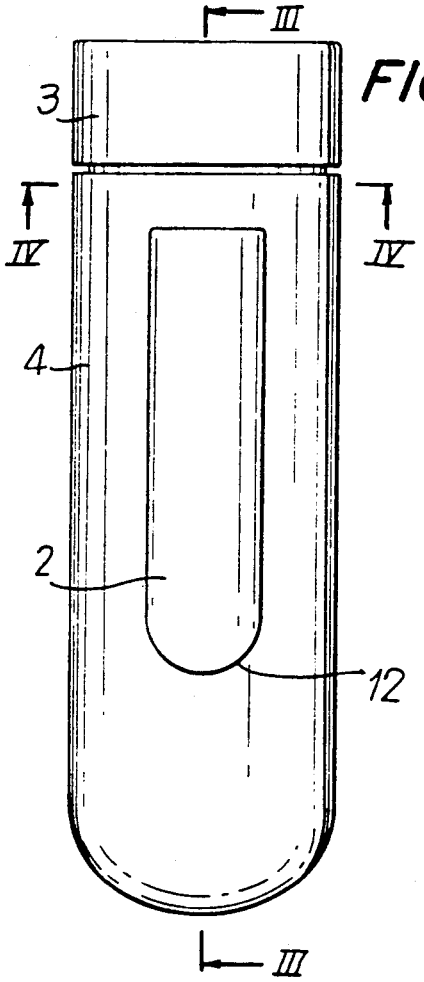
FIG. 1
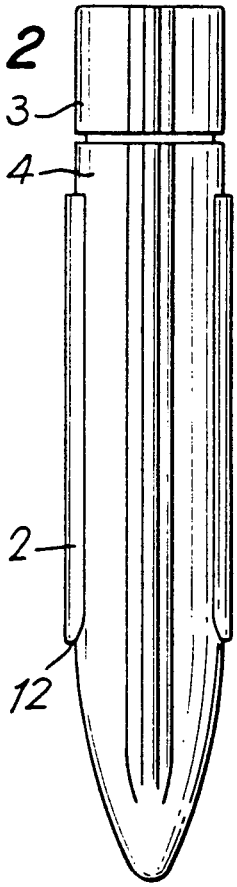
FIG. 2
FIG. 4
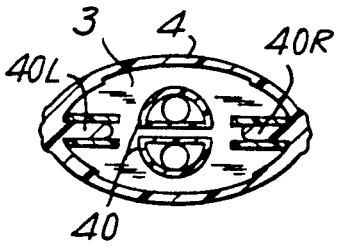
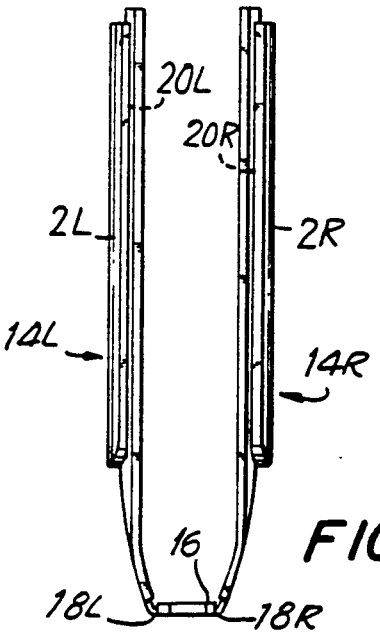
FIG. 5

DUAL TUBE DISPENSER

BACKGROUND OF THE INVENTION

1. Field of the Invention

The invention concerns a package simultaneously dispensing two separate compositions.

2. Related Art

Often there is a need for separately packaging different compositions during storage which compositions must later be combined at the point of use. Separation may be required because of chemical reactivity or physical incompatibility during the storage period. Certain health and beauty aids, cleaning compositions and dental formulas may be benefited by packaging that separates respective components of these products.

Numerous patents have disclosed packages that separate reactive components of dental formulas. For instance, U.S. Pat. Nos. 1,639,699 and 1,699,532 each to Hopkins describe double collapsible tubes. An inner tube holds a first chemically reactive paste while a second outer tube surrounds the first inner one and holds a second chemically reactive paste. Both inner and outer pastes combine with one another in a common outlet nozzle. A similar system for delivering separate paste and gel dentifrices is described in U.S. Pat. No. 4,211,341 (Weyn).

A number of patents have described side-by-side collapsible tubes for toothpaste compositions having separate components in the respective tube. For instance, see U.S. Pat. No. 4,487,757 (Kiozpeoplou) in FIG. 1 as well as U.S. Pat. Nos. 4,528,180, 4,687,663 and 4,849,213, each of which is to Schaeffer.

A common problem of the known art is the inability to control the relative flow of each component from its respective compartment in the dual delivery system. Especially there is a problem in expressing or extruding equal volumes of the two components. Moreover the known art has not provided a system which can accomplish the foregoing uniform extrusion through manipulation with a single hand movement.

Accordingly, it is an object of the present invention to provide a dual container system containing separate respective compositions whose extrusion can be highly regulated.

It is a further object of the present invention to provide a dual container system with separate compartments containing respective compositions that can be simultaneously extruded therefrom through pressure applied by a single hand thereby freeing the other hand for other manipulations.

It is still a further object of the present invention to provide a dual container system wherein two compartments holding separate compositions can be disposable while the surrounding pressure mechanism is reusable.

SUMMARY OF THE INVENTION

A dual container is provided comprising:

(a) a first flexible-walled compartment;

(b) a second flexible-walled compartment adjacent the first compartment;

(c) a receptacle receiving the first and second compartments, the receptacle having a left wall positioned against a wall of the first compartment and a right wall positioned against a wall of the second compartment, the left and right walls being on opposite sides of the receptacle; and (d) a means in the left and right walls for applying pressure to the respective walls of the first and second compartment.

BRIEF DESCRIPTION OF THE DRAWINGS

The foregoing objects, features and advantages of the present invention will more fully be understood by consideration of the drawing describing an embodiment thereof in which:

FIG. 1 is a front elevational view of the overall dual container system;

FIG. 2 is a side elevational view of the dual container system;

FIG. 4 is a cross-section along the line IV—IV of FIG. 1;

FIG. 5 is a side elevational view of the hinged compression device which is a component of the dual container system;

DETAILED DESCRIPTION

The dual container of the present invention as seen in FIGS. 1 and 2 has a dispensing and storage system 1 whose exit openings may be covered by a cap 3. Exposed on the outside of the dispensing and storage system 1 is a receptacle 4 in the form of a flattened, elongated elliptical shape having a respective left and right wall 4L, 4R symmetrically opposed to one another. The receptacle should be formed of a non-elastic, hard material such as a rigid plastic. Within each of wall 4L, 4R is an elongate shaped window 12L, 12R. Protruding outward through windows 12L, 12R is an elongate button 2L, 2R whose dimensions are closely matched but slightly smaller than those of windows 12L, 12R.

Figure 3:
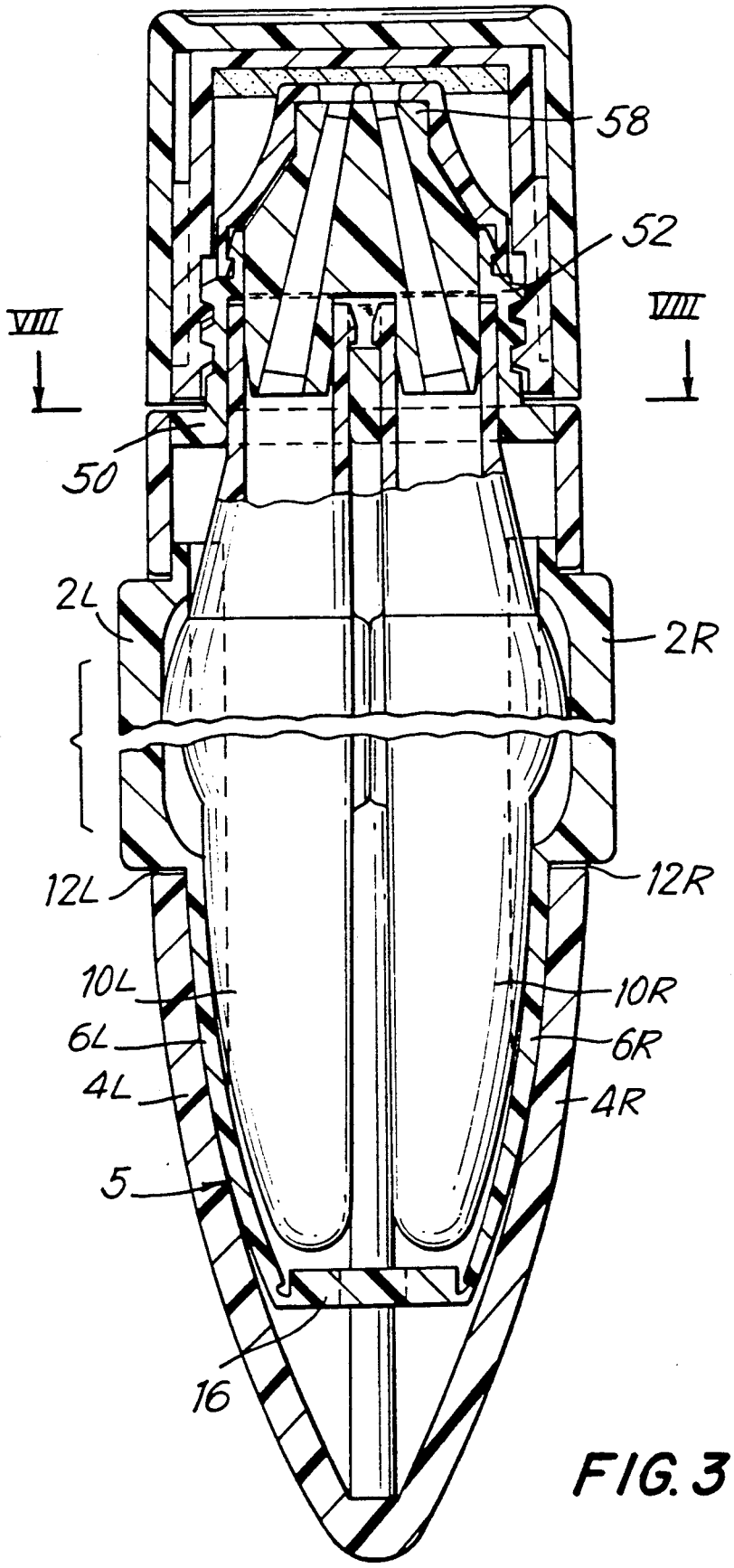
FIG. 3 is a cross section along the line III—III of FIG. 1.

Buttons 2L, 2R comprise part of a compression mechanism 5 which is shown in FIGS. 3 and 5. The compression mechanism 5 will comprise a pair of wings 14L, 14R each slightly, bowed outwardly, formed with buttons 2L, 2R and hingedly connected with one another through hinges 18L, 18R attached to bridge 16. On inward surfaces of buttons 2L, 2R there is provided an indentation relative to surfaces of the respective wings. These indentations 20L, 20R conform in shape to the respective buttons 2L, 2R. Compression mechanism 5 is insertable within and non-attached to receptacle 4.

Figure 6:
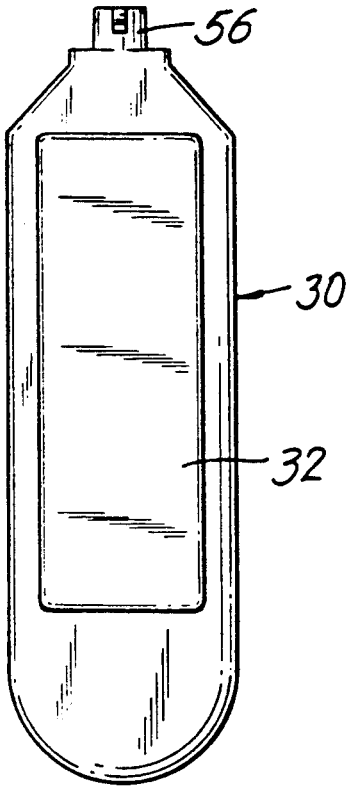
FIG. 6 is a front elevational view of one compartment for storing extrudable compositions, the compartment being a component of the dual container system as shown in FIG. 1.
Figure 7:
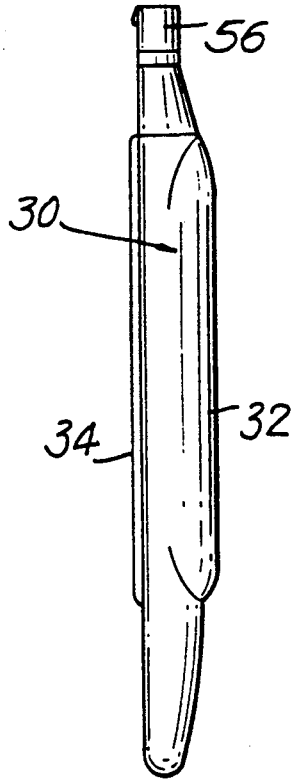
FIG. 7 is a side elevational view of the one compartment shown in FIG. 6.

FIGS. 6 and 7 illustrate one of two compartments 30 which are positioned back-to-back within receptacle 4. Compartment 30 conforms in general elongate shape to that of the receptacle 4. Each compartment has two major surfaces, one of which is formed with an outwardly convex bulge 32 and the other of which is formed with a rectangular outwardly protruding flat surface 34. The pair of compartments 30 are positioned back-to-back with the flattened surfaces 34 adjacent to one another. Bulge walls 32 are positioned adjacent respective indentations 20 of the compression mechanism 5.

Inwardly projecting fins 40L, 40R as shown in FIG. 4 run the length of opposite inner walls of receptacle 4 and are oriented at substantially right angles with the compression mechanism 5. Fins 40L, 40R serve as guides to position the pair of compartments 30 on either side of the fins 40L, 40R within the receptacle 4.

Figure 8:
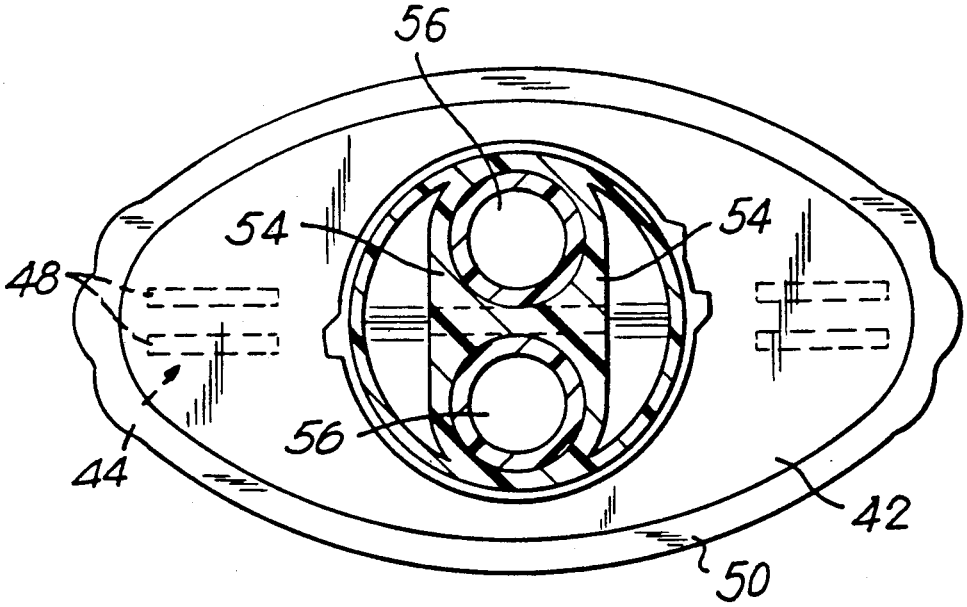
FIG. 8 is a cross-section along line VIII—VIII of FIG. 3.

FIG. 8 shows yoke 50 positioned at an upper end of receptacle 4 and distant from bridge 16 of the compression mechanism 5. Two pairs of guide brackets 44 project downwardly toward an interior of the receptacle and are positioned at opposite ends of the oval under surface 42. Each of brackets 44 have a pair of projections 48 parallel to one another and positioned to slide over and saddle respective fins 40.

An outlet opening 52 projects upwardly away from the receptacle and is positioned on an upper surface of yoke 50. Within the opening 52 are a pair of clamping bars 54 which receive and firmly maintain together exit ports 56 of the pair of compartments 30. A combining nozzle 58 may be placed downstream from the exit ports 56 so that the two streams of composition from respective compartments can be combined.

A wide variety of compositions can be packaged within the compartments. Illustrative compositions are those useful for cleaning or bleaching fabrics, dishware and glassware. Here the first composition may be alkaline whereas the second is acidic, the first composition may contain a bleach while the second may have bleach unstable surfactants or perfume, and the first compartment may have a cationic substance while the second compartment may contain an anionic one.

Health and beauty aids represent another area where the dual container may be of use. For instance, one side may contain a make-up composition while the other may contain a facial lotion.

Dentifrices may be formulated in the dual compartment with one containing a bicarbonate toothpaste while the other a peroxide composition.

It is to be understood, however, that the dual container of the present invention is not intended to be limited by any specific composition. The foregoing examples illustrate only selected possibilities to demonstrate the very wide adaptability of the dual container. Further it is to be noted that the selected embodiment of the dual compartment is merely a non-limiting example with variations and modifications thereof all being within the spirit and purview of this invention.

What is claimed is:

1. A dual container comprising:

(a) a first flexible-walled compartment;

(b) a second flexible-walled compartment adjacent said first compartment;

(c) a receptacle having an open first end and receiving said first and second compartments, said receptacle having a left wall juxtaposed against a wall of said first compartment and a right wall juxtaposed against a wall of said second compartment, said left and right walls being on opposite sides of said receptacle and each formed with a window communicating with an inner area of said receptacle; and (d) a means for applying pressure to respective walls of said first and second compartment, said means being a U-shaped device inserted within said receptacle and receiving both first and second compartments within an area defined by said U-shape, said means comprising a pair of wings and a bridge positioned between said wings for connecting said respective wings, said wings being formed each with a respective button protruding outwardly through a respective one of said windows and said open first end of said receptacle having rigid dimensions for receipt of said U-shaped device and compartments.

2. A container according to claim 1 wherein each of said buttons has an inner surface in contact with said respective wall of said first and second compartments.

3. A container according to claim 2 wherein said buttons are of elongate shape, conform to said window in shape and traverse more than halfway down a length of said receptacle.

4. A dual container according to claim 3 wherein said buttons have an outwardly bowed curvature, said curvature including respective indentations on an inner surface of said buttons.

5. A dual compartment according to claim 4 wherein said compartments are formed with an outwardly bulging wall, said bulging wall being form-fittingly received in said respective indentations.

6. A dual container according to claim 5 wherein each of said compartments has a substantially rectangular shaped flat surface wall on a side of said compartment opposite said bulging wall.

7. A container according to claim 6 wherein said first and second compartments have their respective flat surfaced walls adjacent one another.

8. A container according to claim 1 further comprising a pair of fins projecting inwardly from said left and right walls, opposite one another and substantially at right angles to said means for applying pressure.

9. A container according to claim 8 further comprising a yoke receivable over said open first end of said receptacle, said yoke including a pair of brackets on an underside of said yoke projecting downwardly to engage said fins.

10. A container according to claim 9 wherein said yoke has an opening in a center thereof and contains a means for clamping exit ports through which compositions held in said first and second compartments can be extruded through.

11. A container according to claim 1 wherein said means of applying pressure is inserted within said receptacle replaceably attached therein.

12. A container according to claim 1 further comprising a yoke receivable over an opening in an end of said receptacle.

13. A container according to claim 1 wherein said U-shaped device is of a unitary construction.

14. A container according to claim 1 further comprising a means for hingedly connecting said respective wings with said bridge.

* * * * *